US010059134B2

(12) United States Patent
Akahane et al.

(10) Patent No.: US 10,059,134 B2
(45) Date of Patent: Aug. 28, 2018

(54) PRINTING APPARATUS

(71) Applicant: SEIKO EPSON CORPORATION, Tokyo (JP)

(72) Inventors: Takashi Akahane, Miyata-Mura (JP); Toru Hayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/293,329

(22) Filed: Oct. 14, 2016

(65) Prior Publication Data

US 2017/0106682 A1 Apr. 20, 2017

(30) Foreign Application Priority Data

Oct. 16, 2015 (JP) ..... 2015-204362

(51) Int. Cl.

| | |
|---|---|
| ***B41J 2/01*** | (2006.01) |
| ***B41J 15/16*** | (2006.01) |
| ***B65H 23/16*** | (2006.01) |
| ***B65H 23/195*** | (2006.01) |
| ***B65H 23/198*** | (2006.01) |

(52) U.S. Cl.

CPC ..... *B41J 15/16* (2013.01); *B41J 15/165* (2013.01); *B65H 23/16* (2013.01); *B65H 23/198* (2013.01); *B65H 23/1955* (2013.01); *B65H 2404/62* (2013.01); *B65H 2511/214* (2013.01); *B65H 2513/11* (2013.01); *B65H 2515/842* (2013.01); *B65H 2553/41* (2013.01); *B65H 2801/36* (2013.01)

(58) Field of Classification Search

None

See application file for complete search history.

(56) References Cited

U.S. PATENT DOCUMENTS

2011/0242245 A1* 10/2011 Okazaki ..... B41J 11/0085 347/104
2016/0096384 A1* 4/2016 Kumai ..... B41J 15/165 347/104
2017/0087903 A1* 3/2017 Yamabe ..... B41J 2/01

FOREIGN PATENT DOCUMENTS

JP 5082696 B2 9/2012
JP 2013-022744 A 2/2013
JP 2013 022744 A 2/2013
JP 2014-202862 A 10/2014

OTHER PUBLICATIONS

European Search Report for Application No. 16193780.0 dated Mar. 28, 2017.

* cited by examiner

*Primary Examiner* — Erica Lin
(74) *Attorney, Agent, or Firm* — Workman Nydegger

(57) ABSTRACT

A printing apparatus includes a transport unit which includes a transport roller pair which transports a medium in a transport direction, a printing unit which prints onto the medium, a winding unit which winds the printed medium, and a tension application unit which applies a tension to the medium at a position between the transport roller pair and the winding unit. The tension application unit includes a pair of arms which are capable of rotating. A tension bar is supported on one end of the arms and comes into contact with the medium. The bar is rotated from an upper limit position to a lower limit position by transportation of the transport unit being performed two or more times.

6 Claims, 10 Drawing Sheets

PRINTING APPARATUS

CROSS-REFERENCE TO RELATED APPLICATIONS

The present application claims priority to Japanese Patent Application No. 2015-204362 filed on Oct. 16, 2015, which is hereby incorporated by reference in its entirety.

BACKGROUND

1. Technical Field

Embodiments of the present invention relate to a printing apparatus.

2. Related Art

A large format printing apparatus is configured with a so-called roll-to-roll system which supplies a long medium as a paper roll, and, using a winding unit, winds and collects the medium that is transported by a transport unit and that is subjected to printing by a printing unit. The printing apparatus is also provided with a tension application unit that generates tension in the medium between the transport unit and the winding unit in order to cause the medium to be stably wound onto the winding unit. For example, JP-A-2013-22744 discloses a recording apparatus (a printing apparatus) which is provided with a tension application mechanism that includes a tension application member and a pair of arm members which support the tension application member, and that applies tension to a band-shaped medium. The tension application mechanism is provided with an upper limit sensor which obtains the upper limit of an inclination angle of an arm member and a lower limit sensor which obtains the lower limit of the inclination angle. The winding of the medium onto the winding unit is controlled by these sensors, and tension within a predetermined range is caused to act on the medium by causing the tension application member to rock in a fixed angular range.

However, in the printing apparatus described in JP-A-2013-22744, the center of gravity position of the tension application unit is concentrated on a tension bar (the tension application member). In order to keep the tension which is caused to act of the medium between the transport unit and the winding unit within the predetermined range, it is necessary to narrow the angular range (the rotational range) in which the tension bar is caused to rock or move. As a result, it is necessary to repeat the transportation and the winding of the medium. In addition to the tension of the tension application unit, a tension that is generated by the driving force when winding the medium onto the winding unit also acts on the medium. In a transport path from a transport roller of the transport unit which transports the medium to the winding unit, in a case in which there is a difference in the transport path length from one end side of the transport roller to one end side of the winding unit and the transport path length from the other end side of the transport roller to the other end side of the winding unit, slack arises in the medium on the short side of the transport path, and a high tension is generated unevenly on the long side of the transport path. When the winding unit is driven in this state, an unbalanced force is generated in the winding unit, and a force couple is generated in the winding unit. The force couple is centered on the end portion of the short side of the transport path such that the side on which the transport path is longer rotates. Due to this force couple, the tension is concentrated obliquely on the end portion of the short side of the transport path in the transport roller from the end portion of the side at which the transport path is long in the winding unit. When a pulling force to the downstream side in the transport direction arises on the side at which the tension is concentrated becomes greater than the friction force between the medium and the transport roller, the medium of the side at which the tension is concentrated (i.e., the short side of the transport path) slides to the downstream side in the transport direction, and a vicious cycle in which the slack of the medium is further increased is repeated. Due to the increasing slack, twisting and wrinkling may eventually arise in the medium which is wound onto the winding unit.

SUMMARY

Embodiments of the invention can be realized in the following aspects or application examples.

Application Example 1

According to this application example, a printing apparatus is provided that includes a transport unit that includes a transport roller which transports a medium in a transport direction, a printing unit that prints onto the medium, a winding unit that winds the printed medium, and a tension application unit that applies a tension to the medium between the transport roller and the winding unit. The tension application unit includes a pair of arms which are capable of rotating and a tension bar that is supported on one end of the arms and that comes into contact with the medium. The tension bar is rotated from an upper limit position to a lower limit position by transportation of the transport unit being performed two or more times.

According to this application example, the printing apparatus is provided with the tension application unit. The tension application unit includes the arm that is capable of rotating and the tension bar that comes into contact with the medium to apply a tension. The tension bar is rotated from the upper limit position to the lower limit position by the transportation of the transport unit being performed two or more times. For example, in a case in which the tension bar is rotated from the upper limit position to the lower limit position by the transportation of the transport unit being performed five times, a transport distance corresponding to the length of the medium which is transported out from the transport unit in five transportations is held between the transport roller and the winding unit by the tension which is applied to the medium by the tension application unit. In other words, because the printing apparatus may perform the winding of the winding unit one time for every five times the transportation of the transport unit is performed, it is possible to reduce the number of times that the medium is wound onto the winding unit. Thus, the number of times that the winding unit is driven is reduced. Accordingly, there is a reduction in the vicious cycle related to the increasing slack in the medium, the tension concentration and the driving force of the winding unit. More specifically, there is a reduction in a vicious cycle in which the slack of the medium which arises on the long side of the transport path is further increased due to the tension concentration which occurs due to the difference between the transport path lengths in the transport path from the transport roller which transports the medium to the winding unit, and the driving force of the winding unit. Therefore, because flaws such as twisting or wrinkling which arise when the medium with a large slack is wound onto or by the winding unit are suppressed, it is possible to improve the quality of the medium which is wound onto or by the winding unit.

Application Example 2

In the printing apparatus according to the application example, the winding unit winds the medium during a transport stopping period in which the transportation of the transport unit is stopped.

According to this application example, the winding unit winds the medium during the transport stopping period of the transport unit. In the transport driving period during which the transport unit transports the medium the transport roller is rotationally driven to apply a pushing force in the transport direction to the medium. When tension concentration caused by the difference in the transport path lengths and the driving force of the winding unit is generated, the medium of the side on which the tension is concentrated slides more easily from the transport roller to the downstream side in the transport direction. In this application example, because the winding unit is driven in or during the transport stopping period, the medium does not easily slide to the downstream side in the transport direction.

Application Example 3

In the printing apparatus according to the application example, the printing unit includes a recording head that moves reciprocally in a direction that intersects the transport direction and that is capable of ejecting a liquid onto the medium. In this application example, the winding unit winds the medium during a head movement period in which the recording head is moving in a predetermined direction.

According to this application example, the winding unit winds the medium during the head movement period in which the recording head is moving in a predetermined direction. By way of example, the predetermine direction may be the +X direction or the −X direction or outgoing and returning directions of the recording head. There is a case in which differences arise in the landing positions of droplets ejected from the recording head. The landing positions may shift based on the direction in which the recording head is moving. In one direction, the landing positions are shifted to the upstream side. In the other direction, the landing positions are shifted to the downstream side. The landing positions of droplets which are ejected from the recording head land on one side of either the upstream side or the downstream side in the transport direction of the medium depending on the direction of movement of the recording head in the outgoing and return directions. For example, in a case in which the medium slides to the downstream side during a phenomenon (e.g., rotation of the recording head due to movement in one of the outgoing and return directions) in which the landing position of the droplets which are ejected during the movement of the recording head in the one direction of the outgoing and return directions shifts to the downstream side, the landing position shift amount onto the medium and the sliding amount of the medium cancel each other out. Conversely, in a case in which the medium slides to the downstream side during a phenomenon (e.g., rotation of the recording head due to the movement in the other of the outgoing and the return directions) in which the landing position of the droplets which are ejected during the movement of the recording head in the other direction of the outgoing and return directions shifts to the upstream side, the landing position shift amount onto the medium and the sliding amount of the medium are added together. In other words, because a difference arises in the landing position shift amount depending on the direction in which the recording head is moving in a case in which the medium slides to the downstream side due to the driving of the winding unit, the image quality of the images and the like which are printed onto the medium is markedly reduced. Because the winding unit of this application example winds the medium during the head movement period in which the recording head is moving in the predetermined direction (when the sliding of the medium substantially cancels out the shift in the landing position of the ink), it is possible to suppress the reduction in image quality.

Application Example 4

In the printing apparatus according to the application example, the winding unit winds the medium when a transport distance of the medium which is transported by the transport unit reaches a predetermined distance.

According to this application example, the winding unit winds the medium when the transport distance of the medium which is transported by the transport unit reaches the predetermined distance. In other words, because the winding unit does not wind the medium until the transport distance of the medium reaches the predetermined distance, it is possible to reduce the number of times the medium is wound. Thus, it is possible to reduce the number of times the winding unit is driven. Accordingly, there is a reduction in the vicious cycle related to the increasing slack in the medium, the tension concentration and the driving force of the winding unit. More specifically, there is a reduction in a vicious cycle in which the slack of the medium which arises on the long side of the transport path is further increased due to the tension concentration which occurs due to the difference between the transport path lengths in the transport path from the transport roller which transports the medium to the winding unit, and the driving force of the winding unit.

Application Example 5

In the printing apparatus according to this application example, the predetermined distance is less than or equal to a distance obtained using a product of a movement speed of the medium which is wound onto the winding unit and the transport stopping period.

According to this application example, in a case in which the medium is wound in or during the transport stopping period, the maximum length of the medium which may be wound in a single winding of the winding unit may be obtained using the product value of the movement speed when the medium is wound onto the winding unit and the transport stopping period. Because the predetermined distance is shorter than the maximum length of the medium which may be wound in a single winding, it is possible to cause the medium which is transported by the transport unit to be wound onto the winding unit in the transport stopping period.

Application Example 6

In the printing apparatus according to this application example, the rotational range of the arms when winding the medium onto the winding unit may be greater than or equal to 20°.

According to this application example, by causing the rotational range in which the arms rotate when winding the medium onto the winding unit to be greater than or equal to 20°, the length of the medium which is wound onto the winding unit by a single winding becomes longer, and it is possible to reduce the number of times that the medium is wound onto the winding unit. Thus, the number of times that the winding unit is driven is reduced. Accordingly, there is a reduction in the vicious cycle related to the increasing slack in the medium, the tension concentration and the driving force of the winding unit. More specifically, there is a reduction in a vicious cycle in which the slack of the medium which arises on the long side of the transport path is further increased due to the tension concentration which occurs due to the difference between the transport path lengths in the transport path from the transport roller of the transport unit which transports the medium to the winding unit, and the driving force of the winding unit.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1:
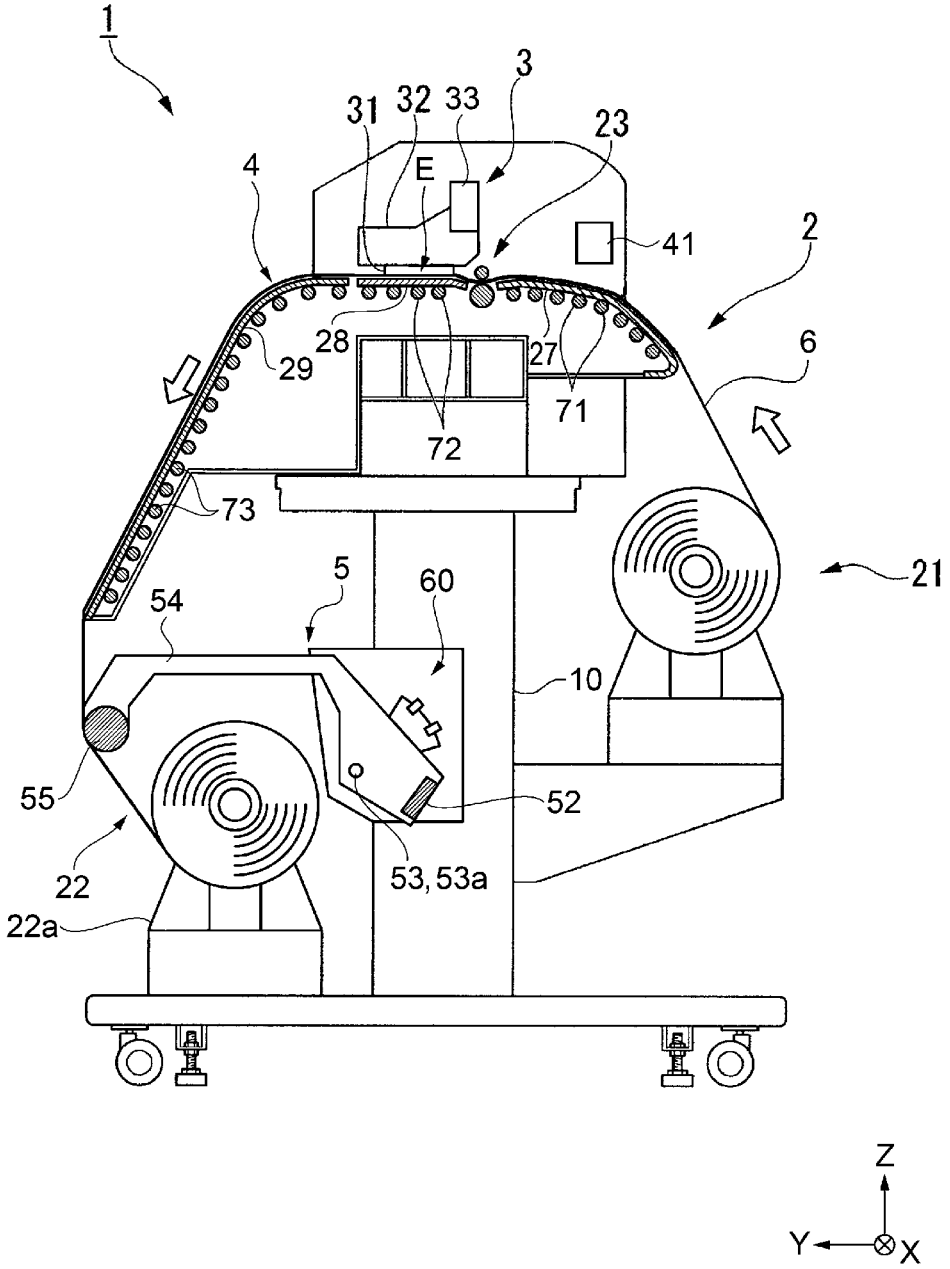
FIG. 1 is a sectional diagram illustrating a schematic configuration of a printing apparatus according to a first embodiment.

Hereinafter, embodiments of the invention will be described with reference to the drawings. In the drawings used in the following description, the scale of each member is depicted differently from actuality to render each member a visually recognizable size.

In FIGS. 1 to 4, and FIGS. 12 to 14, to facilitate explanation, an X axis, a Y axis, and a Z axis are depicted as three orthogonally intersecting axes, and the tip sides of the arrows depicting the axial directions are denoted as "+ sides", and the base sides are denoted as "− sides". A direction parallel to the X axis will be referred to as "an X-axis direction", a direction parallel to the Y axis will be referred to as "a Y-axis direction", and a direction parallel to the Z axis will be referred to as "a Z-axis direction".

First Embodiment

First, description will be given of a configuration of the printing apparatus. The printing apparatus may be an ink jet printer, for example. In the present embodiment, a large format printer (LFP) which handles comparatively large format media will be described as a configuration example of the printing apparatus.

FIG. 1 is a sectional diagram illustrating the schematic configuration of the printing apparatus. As illustrated in FIG. 1, a printing apparatus 1 includes a transport unit 2, a printing unit 3, a medium support portion 4, a tension application unit 5, and the like. The printing apparatus is provided with a control unit 41 which controls the operations of these components. The transport unit 2 transports a medium 6 using a roll-to-roll system, the printing unit 3 ejects an ink (an example of a liquid) onto a predetermined region of the medium 6 to print images, characters, and the like, and the medium support portion 4 supports the medium 6. These components are supported by a main body frame 10. The medium 6 is a vinyl chloride based film or the like with a width of approximately 64 inches, by way of example and not limitation. In the present embodiment, the vertical direction which is parallel to the gravity direction is the Z axis. A direction which intersects the Z axis and in which the medium 6 is transported in the printing unit 3 is the Y axis. The width direction of the medium 6 which intersects both the Z axis and the Y axis is the X axis.

The transport unit 2 includes a feed unit 21 and a winding unit 22. The feed unit 21 feeds the roll-shaped medium 6 out to the printing unit 3 in the transport direction (the arrow direction in the drawing), and the winding unit 22 winds the medium 6 which is subjected to printing by the printing unit and which is fed to the winding unit 22. The transport unit 2 includes a transport roller pair 23 as transport rollers which transport the medium 6 in the transport path between the feed unit 21 and the winding unit 22. In the present embodiment, the printing apparatus 1 which includes the single transport roller pair 23 is exemplified; however, a printing apparatus including a plurality of transport roller pairs may be adopted.

A roll body, around which the unused medium 6 is wound in a cylinder shape, is held in the feed unit 21. A plurality of sizes of roll body with different widths (the length in the X-axis direction) and different winding numbers of the medium 6 are mounted to the feed unit 21 in an exchangeable manner. In other words, the printing apparatus 1 can accommodate mediums of different widths. Due to the feed unit 21 causing the roll body to rotate in a counter-clockwise direction in FIG. 1, the medium 6 is unwound from the roll body and fed to the printing unit 3. The medium 6 which is subjected to printing by the printing unit 3 is wound onto the winding unit 22 in a cylindrical shape to form the roll body. The winding unit 22 is provided with a pair of holders 22*a*. A core for winding the medium may be interposed between or held by the holders 22*a*. The core is used to wind the medium 6 to form the roll body. A winding motor (not illustrated) which supplies a rotational motive force to the core is provided on at least one of the holders 22*a*. The medium 6 is wound onto the core and the roll body is formed due to the winding motor being driven and the core rotating in response to the winding motor being driven.

The printing unit 3 is provided with a recording head 31 and a carriage moving unit 33. The recording head 31 is capable of ejecting a liquid (ink is an example of a liquid) toward the medium 6, and the carriage moving unit 33 causes a carriage 32 on which the recording head 31 is installed to move reciprocally in a direction (the X-axis direction) which intersects the transport direction. The recording head 31 is provided with a plurality of nozzles, and is configured to be capable of ejecting an ink which is selected in relation to the medium 6 and which may require penetration drying or evaporation drying. It is possible to print images, characters, and the like onto the medium 6 by repeating a main scan in which the ink is caused to be ejected from the recording head 31 while the carriage 32 is caused to move reciprocally in the X-axis direction by the carriage moving unit 33, and a sub-scan in which the transport unit 2 transports the medium 6 in the transport direction.

The medium support portion 4 is capable of supporting the medium 6 in the transport path of the medium 6, and includes an upstream-side support portion 27, a platen 28, and a downstream-side support portion 29. The upstream-side support portion 27 is provided between the feed unit 21 and the transport roller pair 23, the platen 28 is disposed to face the printing unit 3, and the downstream-side support portion 29 is provided between the downstream-side end portion of the platen 28 and the winding unit 22.

In one example, the printing apparatus 1 is provided with a first heater 71 (a pre-heater), a second heater 72 (a platen heater), and a third heater 73 (an after heater) which may each heat the medium 6. The first heater 71 preheats the medium 6 closer to the upstream side (the −Y axis side) in the transport direction than the position at which the printing unit 3 is provided. The first heater 71 is disposed on the side of the surface (the surface of the −Z axis side) of the opposite side from the surface which supports the medium 6 in the upstream-side support portion 27. Thus, the medium 6 and the first heater 71 are on opposite sides of the support portion 27 in one example. The second heater 72 heats the medium 6 in an ejection region E of the printing unit 3. The second heater 72 is disposed on the side of the surface (the surface of the −Z axis side) of the opposite side from the surface which supports the medium 6 in the platen 28. Thus, the medium 6 and the second heater 72 are on opposite sides of the platen 28 in one example. The third heater 73 is configured to swiftly dry and fix the ink on the medium 6 by heating the medium 6, and to prevent bleeding and smearing to increase image quality. The third heater 73 is disposed on the side of the surface (the surface of the −Z axis side) of the opposite side from the surface which supports the medium 6 in the downstream-side support portion 29. Thus, the medium 6 and the third heater 71 are on opposite sides of the support portion 29 in one example.

The first, second, and third heaters 71, 72, and 73 are tube heaters, for example, and are bonded to the reverse surfaces of the upstream-side support portion 27, the platen 28, and the downstream-side support portion 29, respectively, via aluminum tubes or the like. By driving the first, second, and third heaters 71, 72, and 73, the surfaces which support the medium 6 in the medium support portion 4 are heated through thermal conduction, and it is possible to heat the medium 6 from the reverse side (the −Z axis side) of the medium 6. For example, the heating temperature of the first heater 71 may be set to 40° C., and the heating temperature of the second heater 72 may be set to 40° C. (a target temperature). The heating temperature of the third heater 73 may be set to 50° C., higher than that of the first heater 71 and the second heater 72.

The first heater 71 is configured to promote swift drying of the ink from the time at which the ink lands by gradually increasing the temperature of the medium 6 from the ambient temperature toward the target temperature (the temperature in the second heater 72). The second heater 72 is configured to cause the medium 6 to receive the landing ink in a state in which the target temperature is maintained to promote swift drying of the ink from the time at which the ink lands. The third heater 73 is configured to cause the medium 6 to be heated to a higher temperature than the target temperature, cause the ink which is yet to swiftly dry among the ink which lands on the medium 6 to dry, and cause the landed ink to be completely dried and fixed to the medium 6 at least before the medium is wound onto the winding unit 22.

The tension application unit 5 applies a tension to the medium 6 at a position between the transport roller pair 23 and the winding unit 22. The tension application unit 5 is configured to be capable of applying the tension to the medium 6 between the downstream-side support portion 29 and the winding unit 22. The tension application unit 5 applies the tension to the medium 6 by rotating on a rotating shaft 53 and coming into contact with the reverse surface of the medium 6 onto which an image or the like is printed by the printing unit 3. The tension application unit 5 is centered on the rotating shaft 53.

Figure 2:
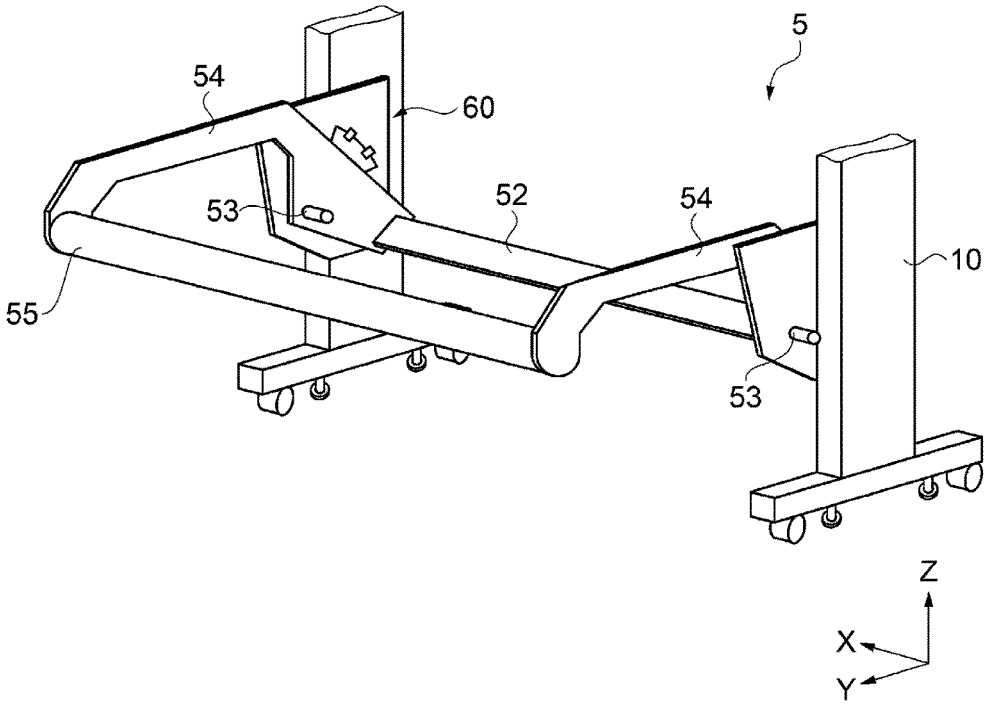
FIG. 2 is a perspective view illustrating a configuration of a tension application unit.

FIG. 2 is a perspective view illustrating an example configuration of the tension application unit. Next, a description will be given of the tension application unit with reference to FIGS. 1 and 2. As illustrated in FIGS. 1 and 2, the tension application unit 5 includes a pair of arms 54, a tension bar 55, and a counterweight 52. The pair of arms 54 are capable of rotating, the tension bar 55 is supported on one end of the pair of arms 54 and comes into contact with the medium 6, and the counterweight 52 is supported on the other end of the pair of arms 54. The tension bar 55 and the counterweight 52 are formed of long members which join the pair of arms 54.

The tension bar 55 is, by way of example only, columnar and is formed to be longer in the width direction than the width of the medium 6. The counterweight 52 is, by way of example only, a rectangular parallelepiped and is formed to be approximately the same length as the tension bar 55. The tension bar 55 and the counterweight 52 form weight portions of the tension application unit 5. The pair of arms 54 are supported by the rotating shaft 53 which is provided on the main body frame 10 between the tension bar 55 and the counterweight 52 which are provided on the ends of the arms 54. Accordingly, the tension application unit 5 is capable of rotating about the rotating shaft 53 and is centered on the rotating shaft 53. The tension bar 55 applies a tension to the medium 6 by coming into contact with the reverse surface of the medium 6 onto which an image or the like is printed by the printing unit 3.

The pair of arms 54 are shaped to be curved in a protruding shape upward in the vertical direction. Due to this shape, it is possible to cause the tension bar 55 to come into contact with the medium 6 while avoiding the holders **22*a* and the like, and it is possible to reduce the dimensions of the tension application unit 5 in the X-axis direction. The holders 22*a* support the shaft which is provided on both ends of the winding unit 22 in the width direction (the X-axis direction) of the medium 6, and winds the medium 6. Accordingly, it is possible to reduce chances for the tension application unit 5 to come into contact with other objects such as the worker or user. Since the torsional rigidity of the tension application unit 5 is improved by the tension application unit 5 being formed of longitudinal members in which the tension bar 55 and the counterweight 52 join the pair of arms 54, even in a case in which the tension application unit 5 comes into contact with another object, it is possible to suppress the deformation of the tension application unit 5**.

Figure 3:
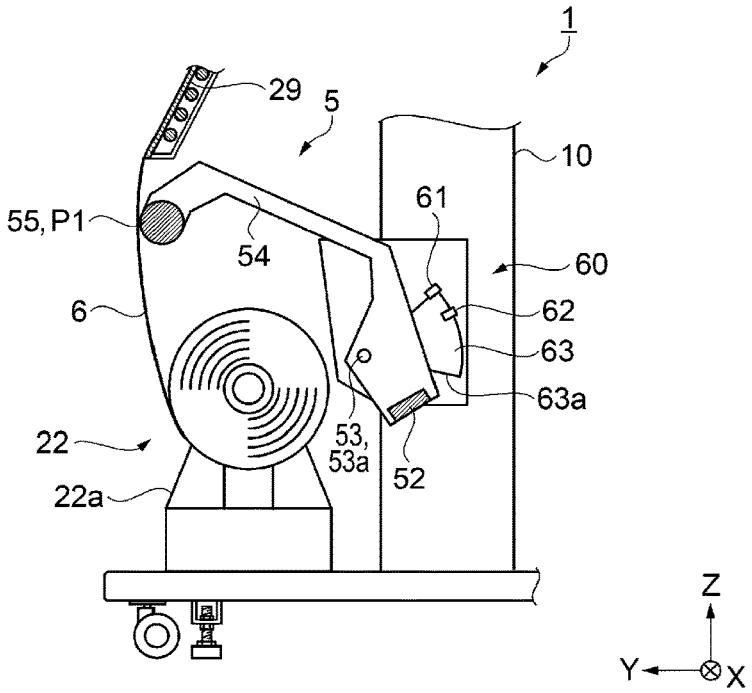
FIG. 3 is a lateral sectional diagram illustrating an upper limit position of a tension bar.
Figure 4:
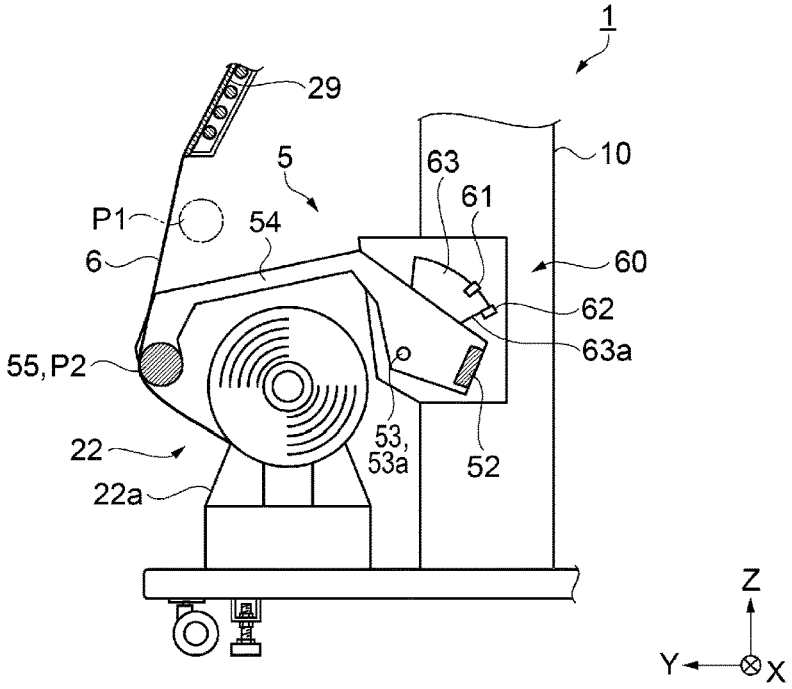
FIG. 4 is a lateral sectional diagram illustrating a lower limit position of the tension bar.
Figure 5:
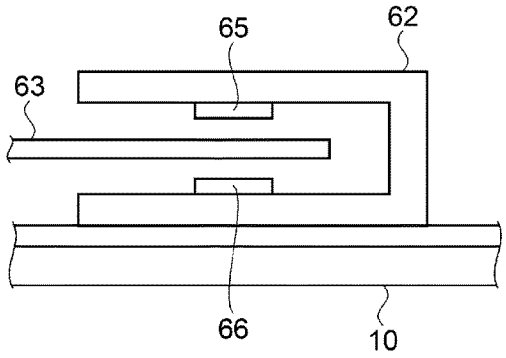
FIG. 5 is a sectional diagram illustrating a configuration of a lower limit sensor.

FIG. 3 is a lateral sectional diagram illustrating an upper limit position of the tension bar. FIG. 4 is a lateral sectional diagram illustrating a lower limit position of the tension bar. FIG. 5 is a sectional diagram illustrating a configuration of the lower limit sensor. A description will be given of the rotational range of the tension bar 55 with reference to FIGS. 3 to 5.

The printing apparatus 1 is provided with a sensor unit 60 for obtaining an upper limit position P1 and a lower limit position P2 of the tension bar 55. The sensor unit 60 includes an upper limit sensor 61, a lower limit sensor 62, and a flag plate 63. In one example, the flag plate 63 is fan-shaped, is centered on the rotating shaft 53 and is provided on the arm 54. The upper limit sensor 61 and the lower limit sensor 62 are so-called transmission-type photo-sensors, and are provided on an outer circumferential edge portion (an arc portion) of the flag plate 63.

Description will be given of the configuration of the lower limit sensor 62. Since the configuration of the upper limit sensor 61 is the same as the configuration of the lower limit sensor 62, description thereof will be omitted. As illustrated in FIG. 5, the lower limit sensor 62 is provided with a light emitting unit 65 and a light receiving unit 66. The light emitting unit 65 includes a light emitting element or the like which emits light, and the light receiving unit 66 includes a light receiving element or the like which receives light. The light emitting unit 65 and the light receiving unit 66 are provided or arranged to face each other. The light which is emitted from the light emitting unit 65 heads toward or is directed towards the light receiving unit 66. The lower limit sensor 62 is provided on the main body frame 10. The flag plate 63 is disposed between the light emitting unit 65 and the light receiving unit 66 and is capable of rotating. FIG. 3 illustrates a state in which the light which is emitted from the light emitting unit 65 is blocked by the flag plate 63 and is not received by the light receiving unit 66. At this time, the lower limit sensor 62 outputs an "OFF" signal. The flag plate 63 rotates counterclockwise centered on the rotating shaft 53 together with the rotation of the arms 54 (the tension application unit 5) from the state of FIG. 3. When a lower limit end portion 63*a* of the flag plate 63 reaches the position illustrated in FIG. 4 from the position illustrated in FIG. 3, the flag plate 63 leaves the space between the light emitting unit 65 and the light receiving unit 66, and a state is assumed in which the light which is emitted from the light emitting unit 65 is received by the light receiving unit 66. At this time, the lower limit sensor 62 outputs an "ON" signal.

The tension application unit 5 applies a tension to the medium 6 while the position of the tension bar 55 is in a range from the upper limit position P1 illustrated in FIG. 3 to the lower limit position P2 illustrated in FIG. 4. In detail, the medium 6 which is subjected to printing by the printing unit 3 is transported by the driving of the transport roller pair 23, and is sequentially transported out from the tip of the downstream-side support portion 29. Accordingly, as the length of the medium 6 between the tip of the downstream-side support portion 29 and the winding unit 22 becomes gradually longer, the tension bar 55 which is positioned at the upper limit position P1 until this point gradually rotates (drops) toward the lower limit position P2 centered on the rotating shaft 53 due to the weight of the tension bar 55. When the tension bar 55 reaches the lower limit position P2, the flag plate 63 which rotates together with the arms 54 leaves the space between the light emitting unit 65 and the light receiving unit 66 of the lower limit sensor 62, and the "ON" signal is output from the lower limit sensor 62.

When the control unit 41 receives the "ON" signal which is output from the lower limit sensor 62, the control unit 41 drives the winding motor which causes the medium 6 to be wound onto the winding unit 22. Accordingly, more tension is applied to the medium 6, and a force which causes the tension bar 55 to rise is generated. As the medium 6 is wound onto the winding unit 22 and the length of the medium 6 between the tip of the downstream-side support portion 29 and the winding unit 22 becomes shorter, the tension bar 55 which is positioned at the lower limit position P2 until this point rotates (rises) toward the upper limit position P1 centered on the rotating shaft 53. When the tension bar 55 reaches the upper limit position P1, the flag plate 63 which rotates together with the arms 54 leaves the space between the light emitting unit 65 and the light receiving unit 66 of the upper limit sensor 61, and the "ON" signal is output from the upper limit sensor 61. When the control unit 41 receives the "ON" signal which is output from the upper limit sensor 61, the control unit 41 stops the driving of the winding motor. By repeating the operations described above, the tension application unit 5 applies a predetermined tension to the medium 6 by causing the tension bar 55 to come into contact with the reverse surface of the medium 6 in a range between the upper limit position P1 and the lower limit position P2 to press the medium 6.

Electrical Configuration of Printing Apparatus

Figure 6:
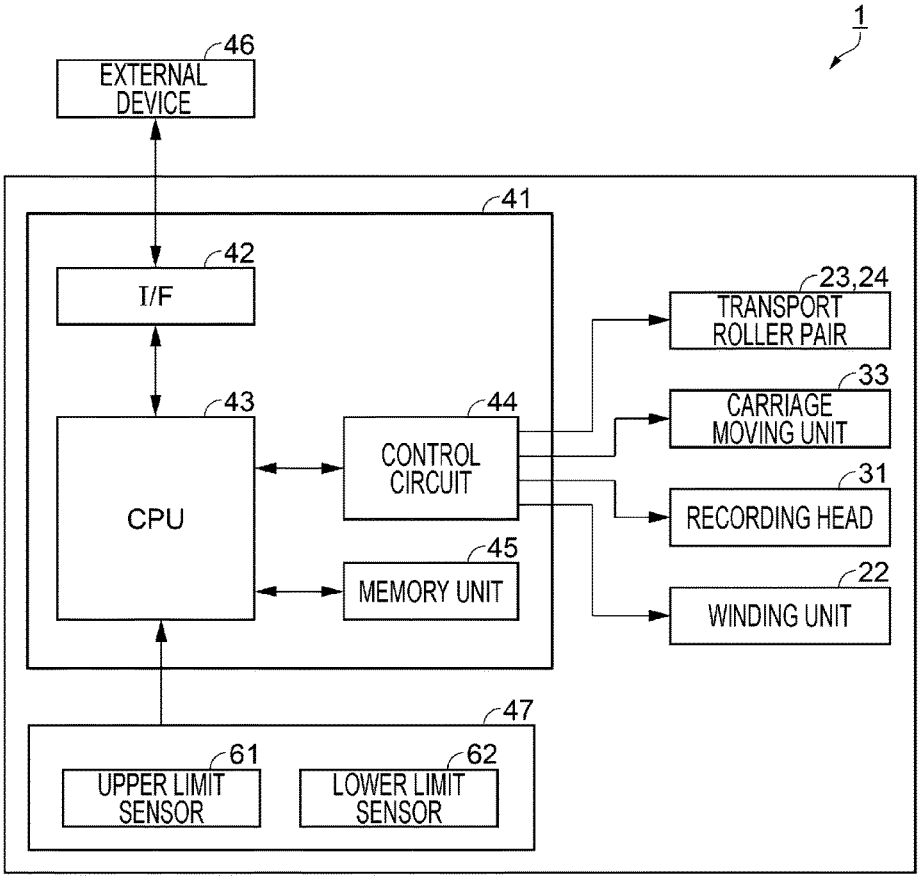
FIG. 6 is a block diagram illustrating an electrical configuration of the printing apparatus.

FIG. 6 is a block diagram illustrating an electrical configuration of the printing apparatus. Next, a description will be given of the electrical configuration of the printing apparatus 1 with reference to FIG. 6.

The control unit 41 is a control unit for performing the control of the printing apparatus 1. The control unit 41 is configured to include a control circuit 44, an interface unit 42 (I/F), a central processing unit 43 (CPU), and a memory unit 45. The interface unit 42 is for performing transmission and reception of data between an external device 46 which handles images such as a computer or a digital camera, and the printing apparatus 1. The CPU 43 is a computational processing device for performing processing of input signals from a detector group 47, and control of the entire printing apparatus 1.

The CPU 43 uses the control circuit 44 to control the transport roller pair 23, 24 which transports the medium 6 in the transport direction, the carriage moving unit 33 which causes the carriage 32 on which the recording head 31 is installed to move in a direction intersecting the transport direction, the recording head 31 which causes the ink to be ejected toward the medium 6, the winding unit 22 which winds the medium 6, and various devices which are not depicted in the drawings based on print data which is received from the external device 46.

The memory unit 45 is for securing a region which stores the programs of the CPU 43, a work region, and the like, and includes memory elements such as random access memory (RAM), electrically erasable programmable read-only memory (EEPROM), or the like. The detector group 47 includes the upper limit sensor 61 for detecting the upper limit position P1 of the tension bar 55 and the lower limit sensor 62 for detecting the lower limit position P2 of the tension bar 55.

Next, a description will be given of the center of gravity position of the tension application unit 5.

Figure 7:
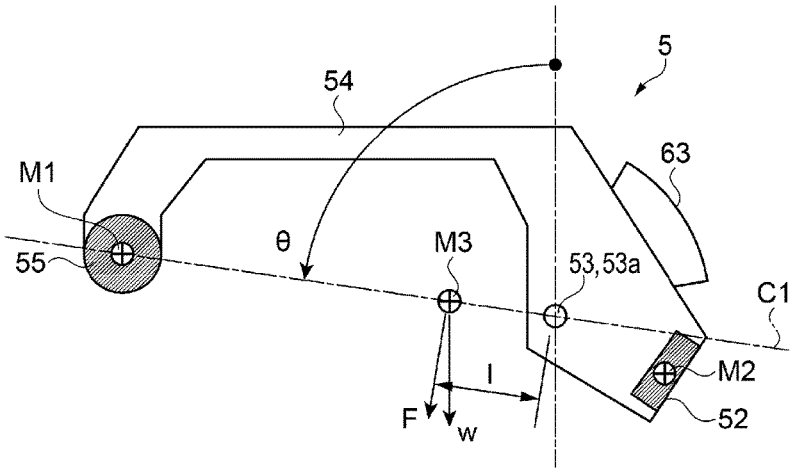
FIG. 7 is a lateral sectional diagram illustrating a configuration of the tension application unit.

FIG. 7 is a lateral sectional diagram illustrating the configuration of the tension application unit. FIG. 7 illustrates a center of gravity position M1 of the tension bar 55, a center of gravity position M2 of the counterweight 52, and a center of gravity position M3 of the entirety of the tension application unit 5. As illustrated in FIG. 7, the center of gravity position M2 of the counterweight 52 is provided lower in the vertical direction than a straight line C1 which joins a rotational fulcrum 53*a* of the arms 54 and the center of gravity position M1 of the tension bar 55. Accordingly, even if the arms 54 are shaped to be curved in a protruding shape upward in the vertical direction, it is possible to cause the center of gravity position M3 of the entirety of the tension application unit 5 to approach the straight line C1 which joins the rotational fulcrum 53*a* and the center of gravity position M1 of the tension bar 55. Because the center of gravity position M2 of the counterweight 52 is provided on the opposite side from the center of gravity position M1 of the tension bar 55 in relation to a vertical straight line passing through the rotational fulcrum 53*a*, the center of gravity position M3 of the entirety of the tension application unit 5 approaches the rotational fulcrum 53*a* side, and a distance l between the center of gravity position M3 and the rotational fulcrum 53*a* becomes shorter.

Figure 14:
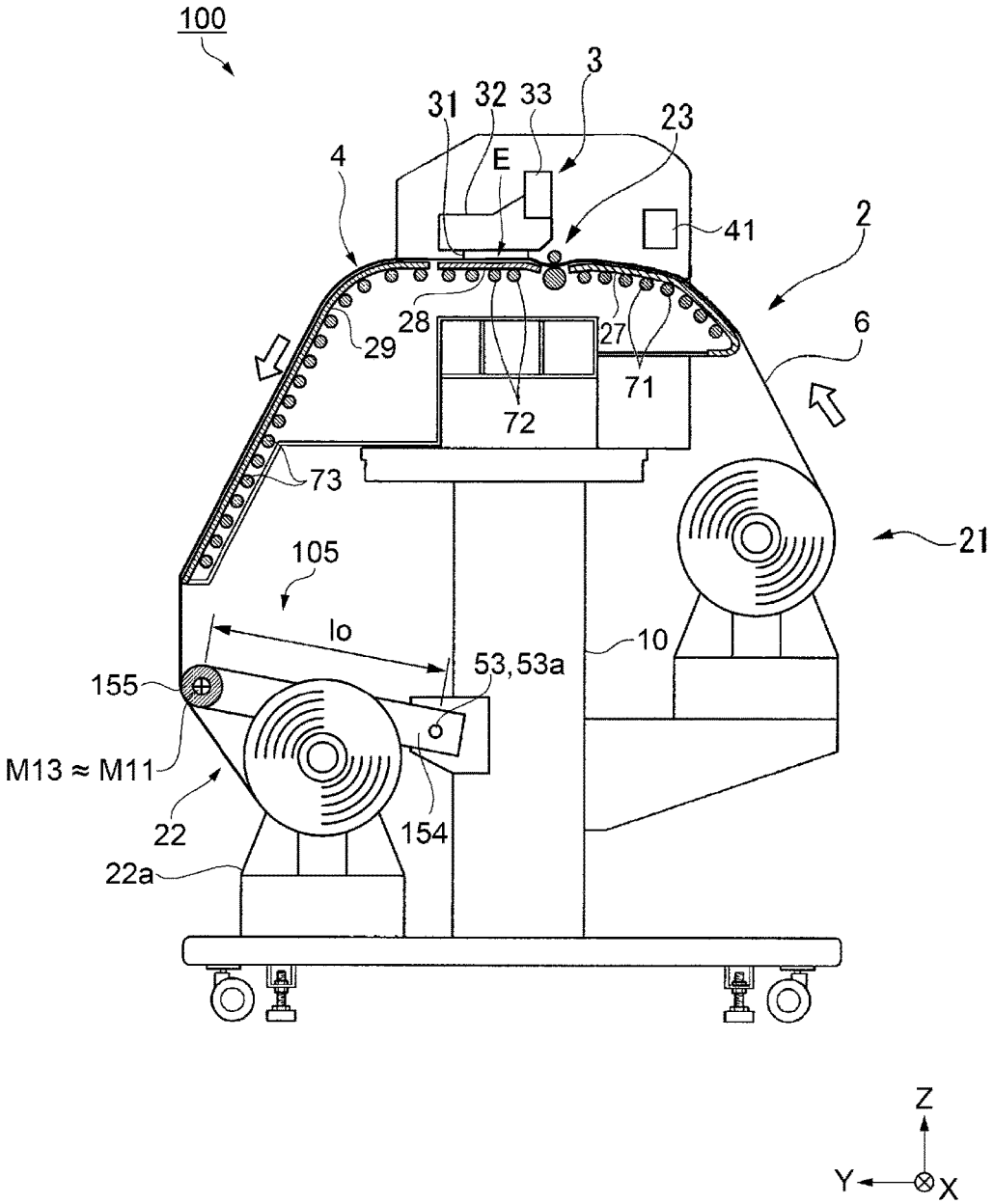
FIG. 14 is a lateral sectional diagram illustrating a printing apparatus which is provided with a tension application unit of the related art.

FIG. 14 is a lateral sectional diagram illustrating a printing apparatus which is provided with a tension application unit of the related art.

Here, description will be given of the printing apparatus of the related art with reference to FIG. 14. Components which are the same as those in the embodiments will be given the same signs, and duplicate description will be omitted.

As illustrated in FIG. 14, a printing apparatus 100 includes a tension application unit 105. The tension application unit 105 is configured to be capable of applying a tension to the medium 6 between the downstream-side support portion 29 and the winding unit 22. The tension application unit 105 includes a pair of arms 154 which are capable of rotating, and a tension bar 155 which is supported on the tips of the pair of arms 154 and which comes into contact with the medium 6. The tension bar 155 is columnar and is formed to be longer in the width direction than the width of the medium 6. The arms 154 are rod-shaped, and the base ends of the pair of arms 154 are supported by the rotating shaft 53. Accordingly, the tension application unit 105 becomes capable of rotating centered on the rotating shaft 53, and the tension bar 155 applies a tension to the medium 6 by coming into contact with the reverse surface of the medium 6 onto which an image or the like is printed by the printing unit 3. Since the tension application unit 105 is not provided with a counterweight, a center of gravity position M13 of the entirety of the tension application unit 105 substantially matches a center of gravity position M11 of the tension bar 155.

Figure 8:
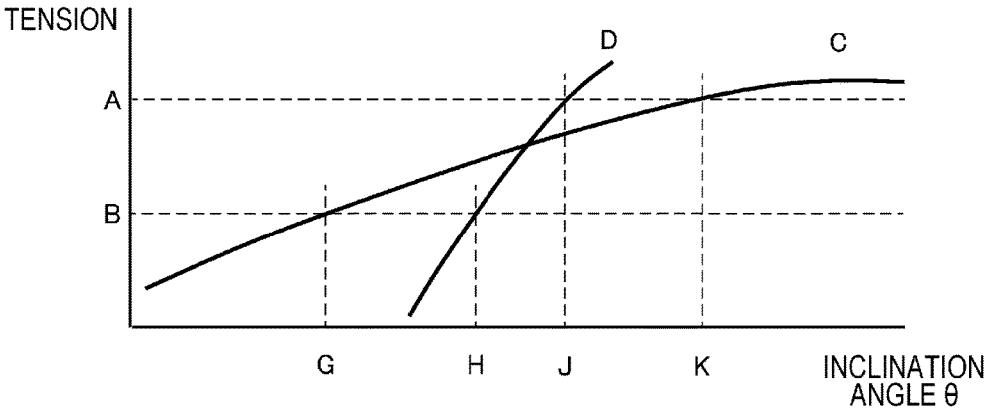
FIG. 8 is a diagram illustrating a relationship between an inclination angle of arms and a tension of a medium.

FIG. 8 is a diagram illustrating the relationship between the inclination angle of the arms and the tension of the medium.

Next, a description will be given of the rotational range in which the tension bar is capable of applying tension to the medium with reference to FIGS. 7 and 8. In the following description, in FIG. 7, an angle formed between the straight line C1 which joins the rotational fulcrum 53*a* and the center of gravity position M1 of the tension bar 55 and the vertical straight line is θ, and θ refers to the inclination angle of the arms 54. In FIG. 14, an angle formed between the straight line which joins the rotational fulcrum 53*a* and the center of gravity position M11 of the tension bar 155 and the vertical straight line is θ (not illustrated), and θ refers to the inclination angle of the arms 154.

The horizontal axis of FIG. 8 represents the inclination angle θ of the arms 54 or 154, and the vertical axis represents the tension that is applied to the medium 6 when the medium 6 is pressed by the tension bar 55 or 155 which is positioned at the inclination angle θ. A dashed line A in FIG. 8 indicates a predetermined upper limit tension which is applied to the medium 6, and a dashed line B indicates a predetermined lower limit tension which is applied to the medium 6. A curve C indicates the tension which is applied to the medium 6 by the tension application unit 5 of the present embodiment, and a curve D indicates a tension which is applied to the medium 6 by the tension application unit 105 of the related art.

A load F which presses the medium 6 in order to apply tension to the medium 6 is represented by the following equation, where a mass of the tension application unit 5 is w, and the distance between the rotational fulcrum 53*a* and the center of gravity position M3 of the tension application unit 5 is l (refer to FIG. 7).

$$F = w \cdot l \cdot \sin\theta \qquad \text{(Equation 1)}$$

According to Equation 1, it can be ascertained that the load F varies depending on the inclination angle θ, and the variation amount of the load F decreases proportionally to the distance l when the distance l becomes shorter. Accordingly, the tension which is applied to the medium 6 also decreases. As illustrated in FIG. 14, since the tension application unit 105 of the related art is not provided with a counterweight, a distance lo between the rotational fulcrum 53*a* and the center of gravity position M13 of the tension application unit 105 is approximately equal to the center of gravity position M11 between the rotational fulcrum 53*a* and the tension bar 155. Therefore, since the distance l between the rotational fulcrum 53*a* and the center of gravity position M3 of the tension application unit 5 of the present embodiment is markedly shorter than the distance lo between the rotational fulcrum 53*a* and the center of gravity position M13 of the tension application unit 105 of the related art, when comparing the curve C of the present embodiment to the curve D of the related art, the variation amount in the tension is markedly smaller.

An inclination angle G is the intersection point between the curve C and the predetermined lower limit tension B, and indicates the inclination angle of the arms 54 when the tension bar 55 is positioned at the upper limit position P1. An inclination angle K is the intersection point between the curve C and the predetermined upper limit tension A, and indicates the inclination angle of the arms 54 when the tension bar 55 is positioned at the lower limit position P2. From the inclination angle G to the inclination angle K represents an inclination angle range (the rotational range) of the arms 54 when winding the medium 6 onto the winding unit 22, that is, represents the rotational range of the tension bar 55. By causing the inclination angle G and the inclination angle K to match the physical rotational limits at which the tension bar 55 is capable of contacting the medium 6, it is possible to maximize the rotational range of the tension bar 55.

An inclination angle H is the intersection point between the curve D and the predetermined lower limit tension B. An inclination angle J is the intersection point between the curve D and the predetermined upper limit tension A. From the inclination angle H to the inclination angle J represents an inclination angle range (the rotational range) of the arms 154 when winding the medium 6 onto the winding unit 22 in the related art, that is, represents the rotational range of the tension bar 155. As can be ascertained by comparing the curve C with the curve D, according to the tension application unit 5 of the present embodiment, it is possible to greatly expand the rotational range of the tension bar 55 in comparison with the tension application unit 105 of the related art. Specifically, by setting the distance l between the rotational fulcrum 53*a* and the center of gravity position M3 of the entirety of the tension application unit 5 between 5 mm and 25 mm in relation to a length of 340 mm from the rotational fulcrum 53*a* to the tension bar 55, it is possible to expand the rotational range of the tension bar 55 (the arms 54) when winding the medium 6 onto the winding unit 22 by 20° or greater.

Here, a description will be given of the slack of the medium 6 with reference to FIGS. 8 and 14.

As illustrated in FIG. 14, the transport roller pair 23 is rotationally driven, and a pushing force in the transport direction is applied to the medium 6. A pulling force (tension) in the transport direction is applied to the medium 6 through the rotational driving of the tension application unit 5 and the winding unit 22. The medium 6 is transported from the transport roller pair 23 toward the winding unit 22 by the pushing force and the pulling force.

According to the assembly precision (error) of the printing apparatus 100, in the transport path from the transport roller pair 23 to the winding unit 22, there is a case in which a difference arises between the transport path length of the +X axis side in the width direction of the medium 6, and the transport path length of the −X axis side. For example, in a case in which the transport path length of the +X axis side is slightly shorter than the transport path length of the −X axis side, a little slack arises in the medium 6 in the transport path of the +X axis side.

The medium 6 is transported from the transport roller pair 23 in a state in which the rotational driving of the winding unit 22 is stopped, and when the tension bar 155 of the tension application unit 105 reaches the inclination angle J of the predetermined upper limit tension (the dashed line A) illustrated in FIG. 8, the winding unit 22 is rotationally driven. Accordingly, in addition to the predetermined upper limit tension, a pulling force (tension) is applied to the medium 6 by the rotational driving of the winding unit 22. At this time, in a case in which there is a difference in the transport path length described above, the tension is concentrated from the end portion of the −X axis side, which is the long side of the transport path in the winding unit 22, to the end portion of the +X axis side, which is the short side of the transport path in the transport roller pair 23. Accordingly, a pulling force to the downstream side in the transport direction, which is stronger than that of the end portion of the −X axis side, is generated on the end portion of the +X axis side of the medium 6 in the transport roller pair 23. When the pulling force of the +X axis side becomes greater than the friction force between the medium 6 and the transport roller pair 23, the medium 6 of the +X axis side, that is, the slack side of the medium 6 slides to the downstream side in the transport direction, and a vicious cycle in which the slack of the medium 6 is further increased is repeated.

As described above, in the tension application unit 105 of the printing apparatus 100 according to the related art, since the variation in the tension applied to the medium 6 is great and the rotational range of the tension bar 155 during the winding of the medium 6 onto the winding unit 22 is markedly narrow, it is necessary to repeatedly perform the transporting and the winding of the medium 6. In other words, because the winding motor of the winding unit 22 is frequently driven, the slack of the medium 6 which arises due to the difference in transport path length becomes markedly large. Consequently, twisting and wrinkling may eventually arise in the medium 6 which is wound onto the winding unit 22.

The tension bar 55 of the printing apparatus 1 of the present embodiment rotates from the upper limit position P1 to the lower limit position P2 through the transportation of the transport unit 2 (the transport roller pair 23, 24) being performed two or more times. Specifically, by applying tension to the medium 6 through a rotation from the upper limit position P1 to the lower limit position P2, the tension bar 55 maintains a transport distance corresponding to the length of the medium 6 which is transported out in the transporting from the transport unit 2. Because the rotational range of the tension bar 55 is wide or larger, in the rotation from the upper limit position P1 to the lower limit position P2, it is possible to maintain the transport distance which is transported from the transport unit 2 across two or more times.

In other words, because the printing apparatus 1 may perform the winding of the winding unit 22 one time for every two or more times the transportation of the transport unit 2 is performed, it is possible to reduce the number of times that the medium 6 is wound onto the winding unit 22. Thus, it is possible to reduce the number of times that the winding unit 22 is driven. Accordingly, since the number of times the winding motor of the winding unit 22 is driven is greatly reduced, it is possible to suppress an increase in the slack of the medium 6 which arises due to the difference in the transport path length and the tension caused by the driving of the winding unit 22. Therefore, since flaws such as twisting or wrinkling which arise when the medium 6 with a large slack is wound onto the winding unit 22 are suppressed, it is possible to improve the quality of the medium which is wound onto the winding unit 22.

Operations of Printing Apparatus

Figure 9:
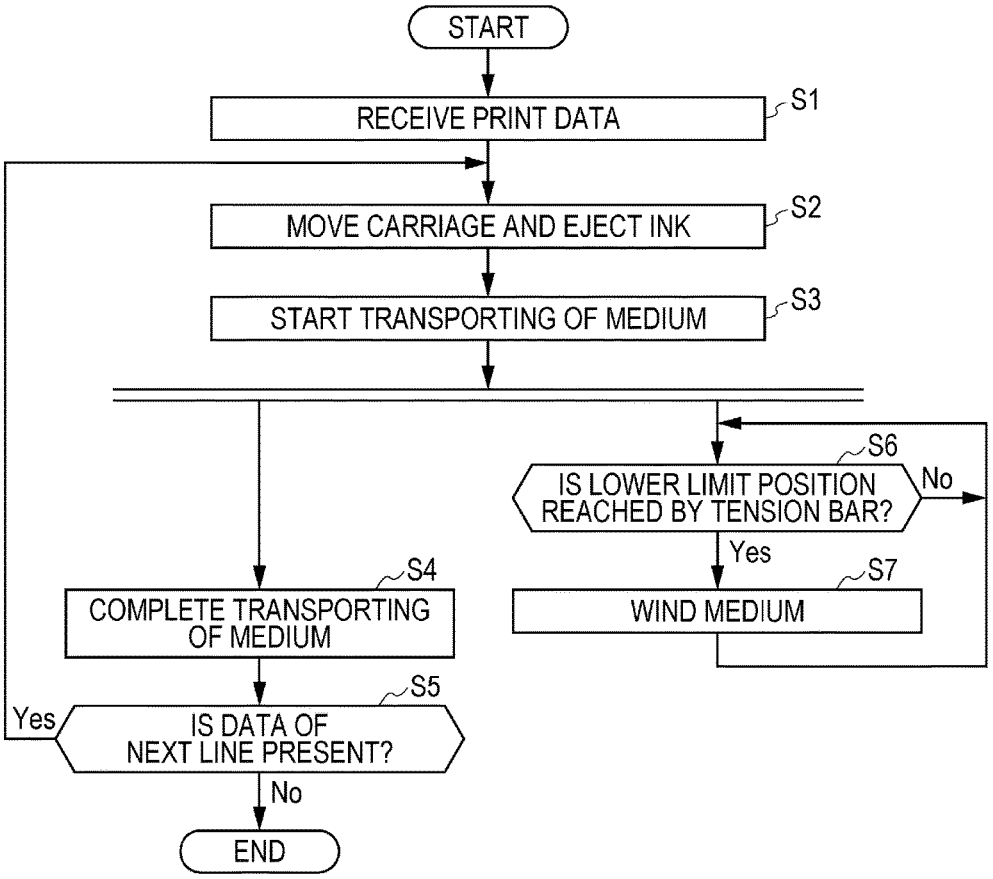
FIG. 9 is a flowchart describing operations of the printing apparatus.

FIG. 9 is a flowchart describing the operations of the printing apparatus. Steps S6 and S7 illustrated in FIG. 9 indicate the winding operation of the winding unit 22 which operates in parallel with the printing operation. Description will be given of the printing operation of the printing apparatus 1 using FIGS. 6 and 9.

In step S1, the print data is received. The CPU 43 receives the print data which is used to record an image onto the medium 6 from the external device 46 and stores the print data in the memory unit 45.

In step S2, the carriage 32 is moved, and the ink is ejected. The CPU 43 performs a main scan in which the ink is ejected toward the medium 6 from the recording head 31 while controlling the carriage moving unit 33 and the recording head 31 using the control circuit 44 to cause the carriage 32 on which the recording head 31 is installed to move in the width direction (the X-axis direction) of the medium 6 which intersects the transport direction. The ink is ejected in accordance with the print data.

In step S3, the transporting of the medium 6 is started. The CPU 43 drives the transport roller pair 23, 24 of the transport unit 2 using the control circuit 44 to start the sub-scan in which the medium 6 is transported in the transport direction.

In step S4, the transporting of the medium 6 is completed. The CPU 43 stops the driving of the transport roller pair 23, 24 once the medium 6 is transported to the next line and completes the sub-scan using the control circuit 44.

In step S5, it is determined whether the print data of the next line is present. The CPU 43 refers to the print data which is stored in the memory unit 45 to determine whether the print data of the next line is present. In a case in which the print data of the next line is present (step S5: Yes), CPU 43 returns to step S2 and repeats steps S2 to S5. Accordingly, the main scan and the sub-scan are repeated, and the image or the like is printed onto the medium 6. In a case in which the print data of the next line is not present (step S5: No), the control unit 41 completes the operation of the printing apparatus 1.

In step S6, the CPU 43 determines whether the tension bar 55 reaches the lower limit position P2. Specifically, in the period between steps S3 and S4 which are performed in parallel, the CPU 43 determines whether the "ON" signal of the lower limit sensor 62 is received. Specifically, the CPU 43 determines that the tension bar 55 reaches the lower limit position P2 by using the lower limit sensor 62 to detect that the tension bar 55 which was positioned in the upper limit position P1 rotates to the lower limit position P2. In a case in which the tension bar 55 reaches the lower limit position P2 (step S6: Yes), the CPU 43 proceeds to step S7. In a case in which the tension bar 55 does not reach the lower limit position P2 (step S6: No), the CPU 43 does not perform any operation.

In step S7, the medium 6 is wound. The CPU 43 drives the winding motor of the winding unit 22 using the control circuit 44 to wind the medium 6 onto the winding unit 22. The CPU 43 stops the driving of the winding motor once the CPU 43 receives the "ON" signal from the upper limit sensor 61. After the completion of the winding operation, the CPU 43 returns to step S6. Accordingly, the medium 6 which is transported two or more times from the transport unit 2 is wound onto the winding unit 22. The winding unit 22 causes the tension bar 55 to rotate from the lower limit position P2 to the upper limit position P1 through the winding of the medium 6 of step S7.

In the winding unit 22, the loop from step S2 to step S5 is repeated two or more times, and until the tension bar 55 reaches the lower limit position P2 from the upper limit position P1, it is possible to reduce the number of times the medium 6 is wound, that is, reduce the number of times the winding motor of the winding unit 22 is driven.

As described above, according to the printing apparatus 1 according to the first embodiment, it is possible to obtain the following effects.

Because there is little variation in the tension which is applied to the medium 6 and because the tension application unit 5 of the printing apparatus 1 of the present embodiment is capable of expanding the rotational range of the tension bar 55, it is possible to wind the medium 6 which is transported in two or more transportations of the transport unit 2 onto the winding unit 22 in a single winding. Accordingly, it is possible to greatly reduce the number of times the medium 6 is wound onto the winding unit 22, that is, reduce the number of times the winding unit 22 is driven. Accordingly, because the number of times the winding unit 22 is driven is reduced, an increase in the slack of the medium 6, which arises due to the difference between the transport path length on the +X axis side and the transport path length on the −X axis side in the transport path from the transport roller pair 23 to the winding unit 22, and the tension during the driving of the winding motor of the winding unit 22, is suppressed. Therefore, because flaws such as twisting or wrinkling which arise when winding the medium 6 with a large slack onto the winding unit 22 are suppressed, it is possible to improve the quality of the medium which is wound onto the winding unit 22.

Because the tension application unit 5 is capable of expanding the rotational range of the tension bar 55 (the arms 54) when winding the medium 6 onto the winding unit 22 by 20° or more, it is possible to render the length of the medium 6 to be wound onto the winding unit 22 in a single winding longer than that of the printing apparatus 100 of the related art. In other words, more of the medium can be wound at a single time. Accordingly, because it is possible to reduce the number of times the medium 6 is wound onto the winding unit 22, that is, reduce the number of times the winding unit 22 is driven, it is possible to suppress an increase in the slack of the medium 6, which arises due to the difference between the transport path length on the +X axis side and the transport path length on the −X axis side in the transport path from the transport roller pair 23 to the winding unit 22, and the tension during the driving of the winding motor of the winding unit 22. In other words, the increase in the slack is suppressed and an increase in the tension is suppressed.

Second Embodiment

Figure 10:
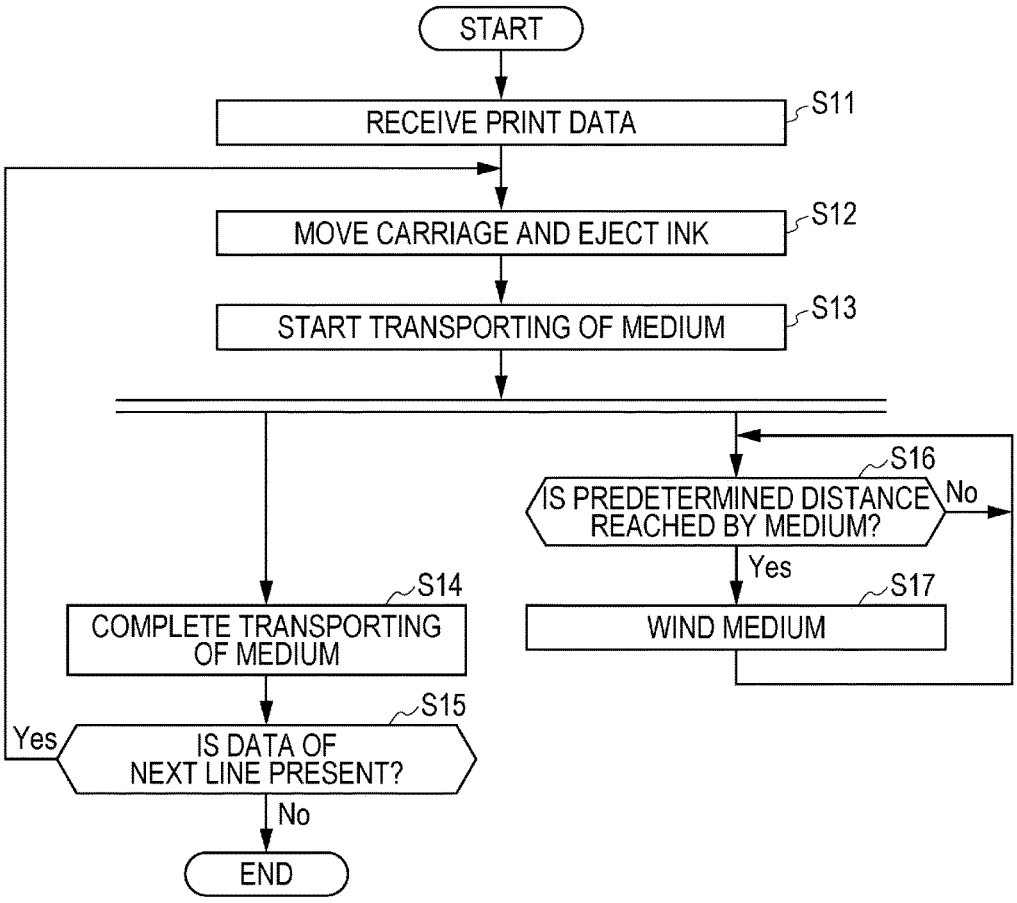
FIG. 10 is a flowchart describing operations of a printing apparatus according to a second embodiment.

FIG. 10 is a flowchart describing the operations of the printing apparatus according to the second embodiment. A description will be given of the operation of the printing apparatus 1 using FIGS. 6 and 10. Because steps S11 to S15 in the flowchart illustrated in FIG. 10 are the same operations as steps S1 to S5 illustrated in FIG. 9 of the first embodiment, description thereof will be omitted.

In the printing apparatus 1 of the present embodiment, the positions of the upper limit sensor 61 and the lower limit sensor 62 are changed or set such that the transport distance (the length of the medium 6 which is transported out from the transport unit 2) of the medium 6 which is held by the tension bar 55 rotating from the upper limit position P1 to the lower limit position P2 is a predetermined distance. The predetermined distance of the medium 6 is set to be less than or equal to a distance which is obtained from the product of the movement speed of the medium 6 which is wound onto the winding unit 22 and the transport stopping period (time) during which the transporting of the transport unit 2 is stopped.

In step S16, the CPU 43 determines whether the transport distance of the medium 6 reaches the predetermined distance. Specifically, in the period between steps S13 and S14 which are performed in parallel in one example, the CPU 43 determines whether the "ON" signal of the lower limit sensor 62 is received. Specifically, the CPU 43 determines that the transport distance of the medium 6 reaches the predetermined distance by using the lower limit sensor 62 to detect that the tension bar 55 which is positioned at the upper limit position P1 until this point rotates to the lower limit position P2. In a case in which the predetermined distance is reached by the medium 6 (step S16: Yes), the CPU 43 proceeds to step S17. In a case in which the predetermined distance is not reached by the medium 6 (step S16: No), the CPU 43 does not perform any operation.

In step S17, the medium 6 is wound. The winding unit 22 winds the medium 6 during the transport stopping period in which the transportation of the transport unit 2 is stopped. Specifically, after the transport operation of the medium 6 is completed in step S14 which is performed in parallel, the CPU 43 drives the winding motor of the winding unit 22 using the control circuit 44 to wind the medium 6 onto the winding unit 22. The CPU 43 stops the driving of the winding motor once the CPU 43 receives the "ON" signal from the upper limit sensor 61. Accordingly, the medium 6 is wound onto the winding unit 22 by a predetermined distance. Thus a predetermined amount of the medium is wound onto the winding unit 22. According to steps S16 and S17, the winding unit 22 winds the medium 6 when the transport distance of the medium 6 which is transported by the transport unit 2 reaches the predetermined distance. Winding the medium by driving the winding unit 22 causes the tension bar 55 to rotate or move from the lower limit position P2 to the upper limit position P1. After the winding operation is completed, the CPU 43 returns to step S16. Since the winding unit 22 does not wind the medium 6 until the transport distance of the medium 6 reaches the predetermined distance, it is possible to reduce the number of times the medium 6 is wound. Thus, the number of times the winding motor of the winding unit 22 is driven is also reduced.

The winding unit 22 winds the medium 6 during the transport stopping period during which the transport unit 2 is stopped. The transport stopping period refers to a period (time) from the completion of the transporting of the medium 6 of step S14 until the start of the transporting of the medium 6 in step S13 after the determination in step S15 is Yes and the CPU 43 returns to step S12. In other words, transport stopping period is the time during which the driving of the transport roller pair 23, 24 is stopped. In a case in which the medium 6 is wound in or during the transport stopping period, the maximum length (distance) of the medium 6 which may be wound in a single winding of the winding unit 22 may be obtained using the product value of the movement speed when the medium 6 is wound onto the winding unit 22 and the transport stopping period. Since the predetermined distance of the present embodiment is shorter than the maximum length of the medium 6 which may be wound in a single winding, it is possible to cause the medium 6 which is transported by the transport roller pair 23, 24 of the transport unit 2 to be wound onto the winding unit 22 in the transport stopping period.

A description will be given of a case in which the winding unit 22 winds the medium 6 during a transport driving period in which the transport unit 2 is transporting the medium 6. During the transport driving period in which the transport roller pair 23, 24 of the transport unit 2 is transporting the medium 6, a pushing out force in the transport direction is applied to the medium 6 by the rotational driving of the transport roller pair 23, 24. Accordingly, when tension concentration occurs due to the difference between the transport path length on the +X axis side and the transport path length on the −X axis side in the transport path from the transport roller pair 23 to the winding unit 22, and the driving force of the winding motor of the winding unit 22, the side of the medium 6 on which the tension is concentrated slides more easily to the downstream side in the transport direction from the transport roller pair 23. Because the printing apparatus 1 of the present embodiment drives the winding motor to wind the medium 6 onto the winding unit 22 during the transport stopping period in which the driving of the transport roller pair 23, 24 of the transport unit 2 is stopped, it is possible to ensure that the medium 6 does not easily slide to the downstream side in the transport direction.

As described above, according to the printing apparatus 1 according to the second embodiment, it is possible to obtain the following effects.

The winding unit 22 of the printing apparatus 1 of the present embodiment winds the medium 6 when the transport distance of the medium 6 which is transported by the transport unit 2 reaches the predetermined distance. In other words, because the winding unit 22 does not wind the medium 6 until the transport distance of the medium 6 reaches the predetermined distance, it is possible to reduce the number of times the medium 6 is wound, that is, the number of times the winding motor of the winding unit 22 is driven. Accordingly, there is a reduction in a vicious cycle in which the slack of the medium 6 which arises on the long side of the transport path is further increased due to the tension concentration which occurs due to the difference between the transport path length on the +X axis side and the transport path length on the −X axis side in the transport path from the transport roller pair 23 to the winding unit 22, and the driving of the winding motor of the winding unit 22.

The winding unit 22 winds the medium 6 in the transport stopping period during which the pushing out force in the transport direction by the rotational driving of the transport roller pair 23, 24 is not applied to the medium 6. Accordingly, when tension concentration occurs due to the difference between the transport path length on the +X axis side and the transport path length on the −X axis side in the transport path from the transport roller pair 23 to the winding unit 22, and the driving force of the winding motor of the winding unit 22, it is possible to suppress the sliding between the side of the medium 6 on which the tension is concentrated and the transport roller pair 23 and it is possible to suppress the medium 6 shifting to the downstream side in the transport direction.

Because the predetermined distance is shorter than the maximum length of the medium 6 which may be wound in a single winding, and which may be obtained by a product value of the movement speed of the medium 6 which is wound onto the winding unit 22 and the transport stopping period, it is possible to cause the medium 6 which is transported by the transport roller pair 23, 24 of the transport unit 2 to be wound onto the winding unit 22 in the transport stopping period in which the transport unit 2 is stopped.

Third Embodiment

Figure 11:
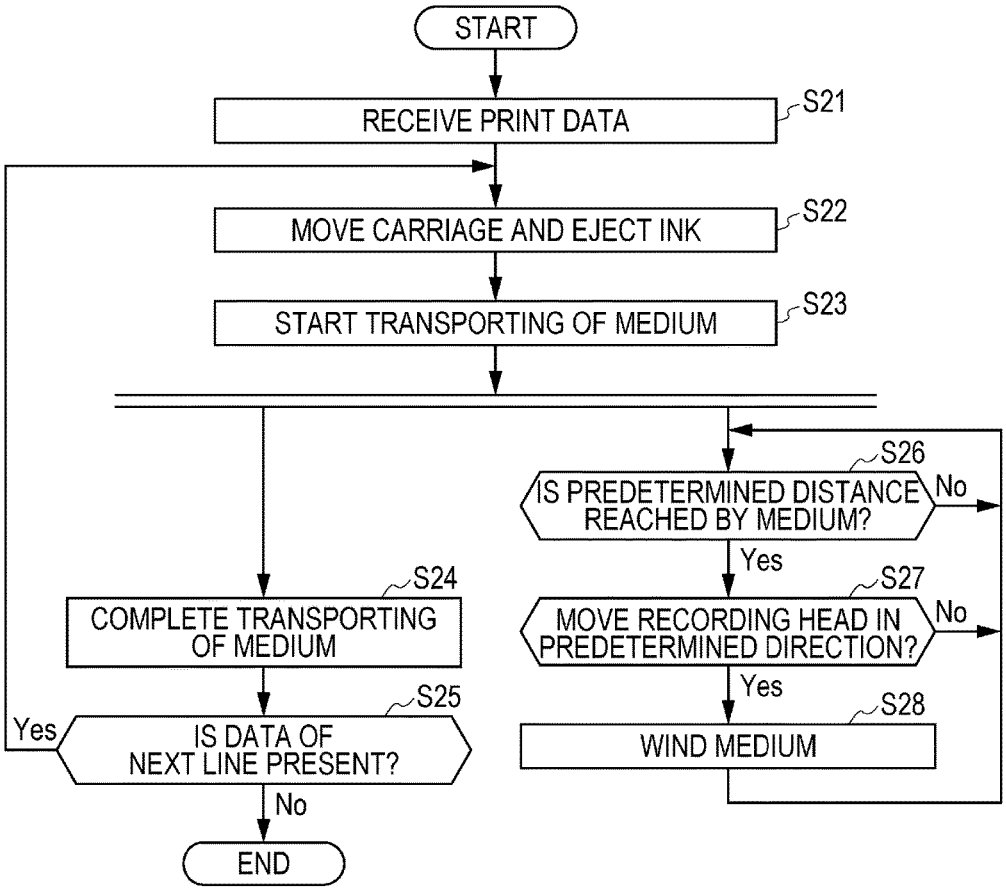
FIG. 11 is a flowchart describing operations of a printing apparatus according to a third embodiment.

FIG. 11 is a flowchart describing the operations of a printing apparatus according to the third embodiment. A description will be given of the operation of the printing apparatus 1 using FIGS. 6 and 11. Because steps S21 to S25 in the flowchart illustrated in FIG. 11 are the same operations as steps S11 to S15 illustrated in FIG. 10 of the second embodiment (and steps S1 to S5 illustrated in FIG. 9 of the first embodiment), description thereof will be omitted.

In the printing operation of the printing apparatus 1 of the present embodiment, the third embodiment differs from the second embodiment in that the winding unit 22 winds the medium 6 during the head movement period in which the recording head 31 is moving in a predetermined direction.

In step S26, the CPU 43 determines whether the transport distance of the medium 6 reaches the predetermined distance. Because the specific operation of this step is the same as that of step S16 illustrated in FIG. 10 of the second embodiment, description thereof will be omitted. In a case in which the predetermined distance is reached by the medium 6 (step S26: Yes), the CPU 43 proceeds to step S27. In a case in which the predetermined distance is not reached by the medium 6 (step S26: No), the CPU 43 does not perform any operation.

In step S27, the CPU 43 determines whether to move the recording head 31 in the predetermined direction. The CPU 43 confirms the movement direction of the carriage 32 on which the recording head 31 is installed when referring to the print data which is stored in the memory unit 45 to print the next line. In a case in which the movement direction of the recording head 31 (the carriage 32) is the predetermined direction (step S27: Yes), the CPU 43 proceeds to step S28.

In a case in which the movement direction of the recording head 31 (the carriage 32) is the opposite direction from the predetermined direction (step S27: No), the CPU 43 returns to step S26. The predetermined direction in which the recording head 31 (the carriage 32) moves may be an outgoing path direction which proceeds from the −X-axis direction to the +X-axis direction, and may be a return path direction which proceeds from the +X-axis direction to the −X-axis direction.

In step S28, the medium 6 is wound. Because the specific operation of this step is the same as that of step S17 illustrated in FIG. 10 of the second embodiment, description thereof will be omitted. According to steps S26 to S28, the winding unit 22 winds the medium 6 when the transport distance of the medium 6 which is transported by the transport unit 2 reaches the predetermined distance and the recording head 31 is moved in the predetermined direction. This causes the tension bar 55 to rotate from the lower limit position P2 to the upper limit position P1. After the completion of the winding operation, the CPU 43 returns to step S26.

It is preferable for the predetermined distance of the medium 6 in the present embodiment to be set to a value obtained by subtracting the transport distance of the medium 6 which is transported in a single transporting of the transport unit 2 from the product value of the movement speed when the medium 6 is wound onto the winding unit 22 and the transport stopping period. Accordingly, even in a case in which the medium 6 is wound when the transport distance of the medium 6 which is transported by the transport unit 2 reaches the predetermined distance and the recording head 31 is moved in the predetermined direction, it is possible to cause the medium 6 to be wound onto the winding unit 22 during the transport stopping period in which the transport unit 2 is stopped.

Next, a description will be given of positional shifting of landed droplets caused by the direction in which the recording head 31 moves.

Figure 12:
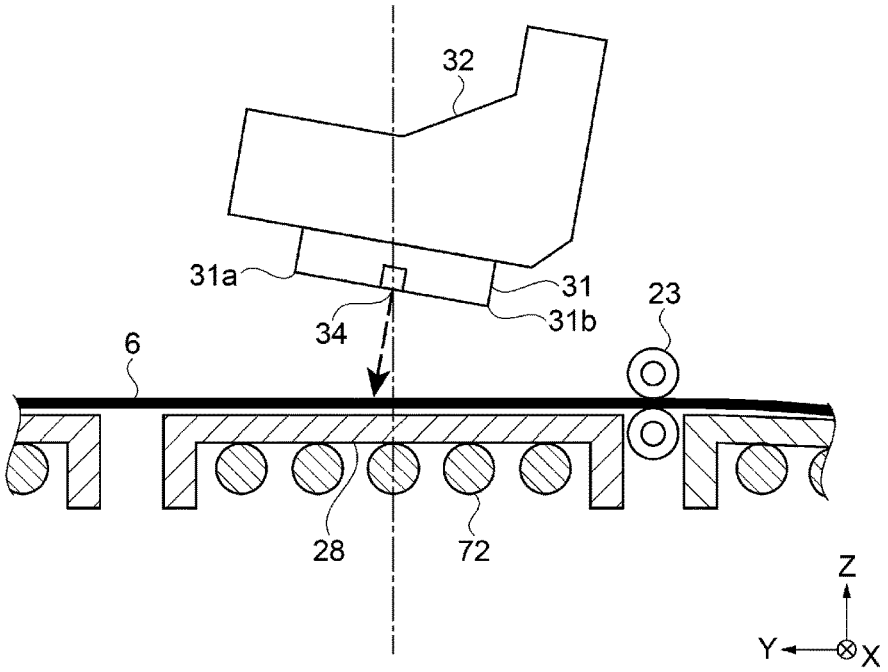
FIG. 12 is a lateral sectional diagram of a recording head during movement in one direction.
Figure 13:
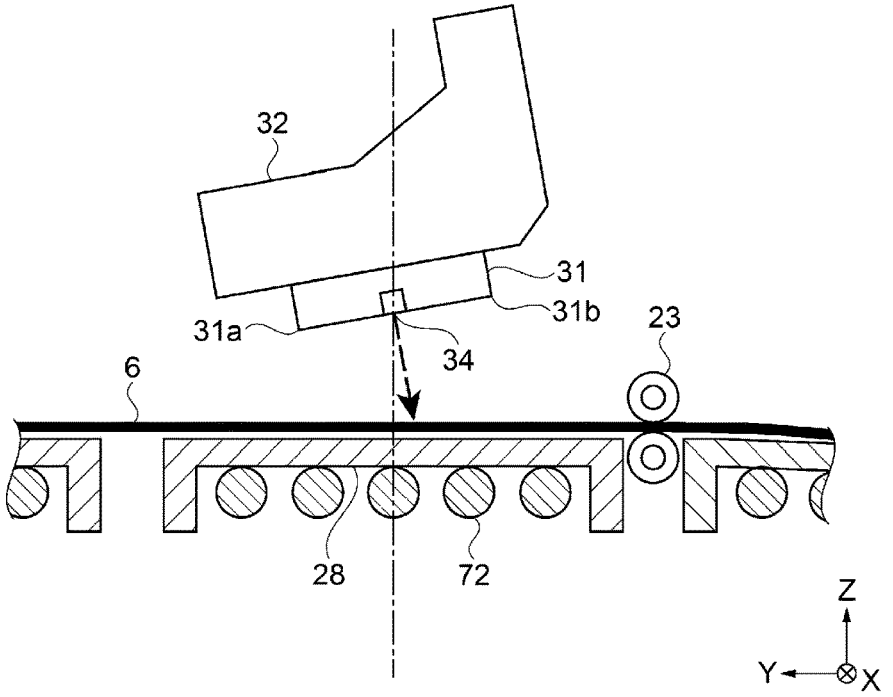
FIG. 13 is a lateral sectional diagram of the recording head during movement in another direction.

FIG. 12 is a lateral sectional diagram of the recording head during movement in one direction. FIG. 13 is a lateral sectional diagram of the recording head during movement in another direction. In the recording head 31 which is installed on the carriage 32, there is a case in which the carriage 32 causes an orientation change depending on the direction of movement in the outgoing and return directions, and differences in landing position shifting in which the droplets which are ejected from a nozzle 34 which is provided in the recording head 31 land on one side of either the upstream side or the downstream side in the transport direction of the medium 6.

As illustrated in FIG. 12, for example, in a case in which the recording head 31 is moving together with the carriage 32 in one direction of the outgoing and return directions (the ±X-axis directions), a phenomenon occurs in which the carriage 32 rotates clockwise around the +X axis. Accordingly, because the interval between an end portion 31*a* of the downstream side of the recording head 31 and the medium 6 becomes wider than an interval between an end portion 31*b* of the upstream side of the recording head 31 and the medium 6, the droplets which are ejected from the nozzle 34 are shifted to land closer to the downstream side in the transport direction than below the nozzle 34 in the vertical direction. In a case in which, during the movement of the recording head 31 in the orientation illustrated in FIG. 12, the medium 6 slides to the downstream side due to the difference between the transport path length on the +X axis side and the transport path length on the −X axis side in the transport path from the transport roller pair 23 to the winding unit 22, and the tension during the driving of the winding motor of the winding unit 22, the landing position shift amount onto the medium 6 and the slide amount of the medium 6 cancel each other out. In FIG. 12, the direction of the droplets which are ejected from the nozzle 34 and the landing position of the droplets are indicated using a dashed line arrow.

As illustrated in FIG. 13, for example, in a case in which the recording head 31 is moving together with the carriage 32 in the other direction of the outgoing and return directions (the ±X-axis directions), a phenomenon occurs in which the carriage 32 rotates counterclockwise around the +X axis. Accordingly, because the interval between the end portion 31*b* of the upstream side of the recording head 31 and the medium 6 becomes wider than the interval between the end portion 31*a* of the downstream side of the recording head 31 and the medium 6, the droplets which are ejected from the nozzle 34 are shifted to land closer to the upstream side in the transport direction than below the nozzle 34 in the vertical direction. In a case in which, during the movement of the recording head 31 in the orientation illustrated in FIG. 13, the medium 6 slides to the downstream side due to the difference between the transport path length on the +X axis side and the transport path length on the −X axis side in the transport path from the transport roller pair 23 to the winding unit 22, and the tension during the driving of the winding motor of the winding unit 22, the landing position shift amount onto the medium 6 and the slide amount of the medium 6 are added together. In FIG. 13, the direction of the droplets which are ejected from the nozzle 34 and the landing position of the droplets are indicated using a dashed line arrow.

As described above, because a difference arises in the landing position shift amount of the droplets between a case in which the medium 6 slides to the downstream side due to the winding unit 22 being driven when the recording head 31 is moving in the one direction, and a case in which the medium 6 slides to the downstream side due to the winding unit 22 being driven when the recording head 31 is moving in the other direction, the image quality of the images and the like which are printed onto the medium 6 is markedly reduced. In the present embodiment, because the winding motor of the winding unit 22 is driven to wind the medium 6 during the head movement period in which the recording head 31 is moving in the predetermined direction of the outgoing and return directions, even in a case in which the medium 6 slides to the downstream side, it is possible to suppress the reduction in image quality caused by the sliding of the medium for reasons discussed herein.

By setting the direction in which the recording head 31 moves in the orientation illustrated in FIG. 12, that is, the direction in which the landing position shift amount onto the medium 6 and the slide amount of the medium 6 cancel each other out to the predetermined direction, it is possible to further suppress the reduction in image quality.

As described above, according to the printing apparatus 1 according to the third embodiment, it is possible to obtain the following effects.

In the winding unit 22 of the printing apparatus 1 of the present embodiment winds the medium 6 during the head movement period in which the recording head 31 is moving in a predetermined direction. Accordingly, even in a case in which the sliding of the medium 6 to the downstream side caused by the difference between the transport path length on the +X axis side and the transport path length on the −X axis side in the transport path from the transport roller pair 23 to the winding unit 22, and the driving force of the winding unit 22, and landing error caused by the movement direction of the recording head 31 which moves reciprocally occur at the same time, it is possible to suppress a reduction in image quality caused by the sliding and the landing error.

What is claimed is:

1. A printing apparatus comprising:

a transport unit that includes a transport roller which transports a medium in a transport direction;

a printing unit that prints onto the medium;

a winding unit that winds the printed medium; and a tension application unit that applies a tension to the medium at a position between the transport roller and the winding unit, wherein the tension application unit includes a pair of arms that are capable of rotating and a tension bar that is supported on one end of the arms and comes into contact with the medium, the pair of arms rotating about an axis, and a center of gravity of the tension application unit is closer to the axis than the tension bar; and wherein the tension bar is rotated from an upper limit position to a lower limit position when transportation of the medium by the transport unit is performed two or more times.

2. The printing apparatus according to claim 1, wherein the winding unit winds the medium during a transport stopping period during which the transportation of the medium by the transport unit is stopped.

3. The printing apparatus according to claim 1, wherein the printing unit includes a recording head which moves reciprocally in a direction which intersects the transport direction and which is capable of ejecting a liquid onto the medium, and wherein the winding unit winds the medium during a head movement period in which the recording head is moving in a predetermined direction.

4. The printing apparatus according to claim 1, wherein the winding unit winds the medium when a transport distance of the medium which is transported by the transport unit reaches a predetermined distance.

5. The printing apparatus according to claim 4, wherein the predetermined distance is less than or equal to a distance obtained using a product of a movement speed of the medium which is wound onto the winding unit and the transport stopping period.

6. The printing apparatus according to claim 1, wherein a rotational range of the arms when winding the medium onto the winding unit is greater than or equal to 20°.

* * * * *